US005713108A

United States Patent [19]

Solomon et al.

[11] Patent Number: 5,713,108

[45] Date of Patent: Feb. 3, 1998

[54] FLEXIBLE BAG SEALING DEVICE

[76] Inventors: Howard Solomon, 310 Morgan Farm Ct., Atlanta, Ga. 30342; Armond Odell Parks, Sr., 260 Laurel Dr.; Armond Odell Parks, Jr., 355 Vaughn Rd., both of Athens, Ga. 30606

[21] Appl. No.: 672,121

[22] Filed: Jun. 27, 1996

[51] Int. Cl.[6] ..... B65D 33/25

[52] U.S. Cl. ..... 24/30.5 R; 24/559

[58] Field of Search ..... 24/30.5 R, 30.5 P, 24/519, 520, 462, 559; 383/63, 78, 68, 69, 65, 81

[56] References Cited

U.S. PATENT DOCUMENTS

| | | | |
|---|---|---|---|
| D. 276,596 | 12/1984 | Kisha . | |
| 1,186,656 | 6/1916 | Fridolph | 24/520 |
| 4,231,141 | 11/1980 | Derrick et al. | 24/462 |
| 4,296,529 | 10/1981 | Brown . | |
| 4,887,335 | 12/1989 | Folkman . | |
| 4,926,526 | 5/1990 | Brown et al. | 24/30.5 R |
| 5,050,272 | 9/1991 | Robinson et al. . | |
| 5,054,168 | 10/1991 | Gandy et al. . | |
| 5,125,133 | 6/1992 | Morrison . | |
| 5,224,306 | 7/1993 | Cramer | 24/464 X |
| 5,542,766 | 8/1996 | Cadwallader | 24/30.5 R X |

FOREIGN PATENT DOCUMENTS

| | | | |
|---|---|---|---|
| WO92/03353 | 3/1992 | WIPO | 24/30.5 R |

*Primary Examiner*—James R. Brittain
*Attorney, Agent, or Firm*—Kennedy, Davis & Kennedy

[57] ABSTRACT

A sealing devise provided for use in sealing flexible bags. The sealing device has a receiving arm (11) and a locking arm (12) each having generally parallel side walls (16, 26) having elongated, seating shoulders (19, 29) for interlocking engagement. The receiving and locking arms are configured to form a hinge (36) for pivotably movement of the arms relative to each other.

10 Claims, 1 Drawing Sheet

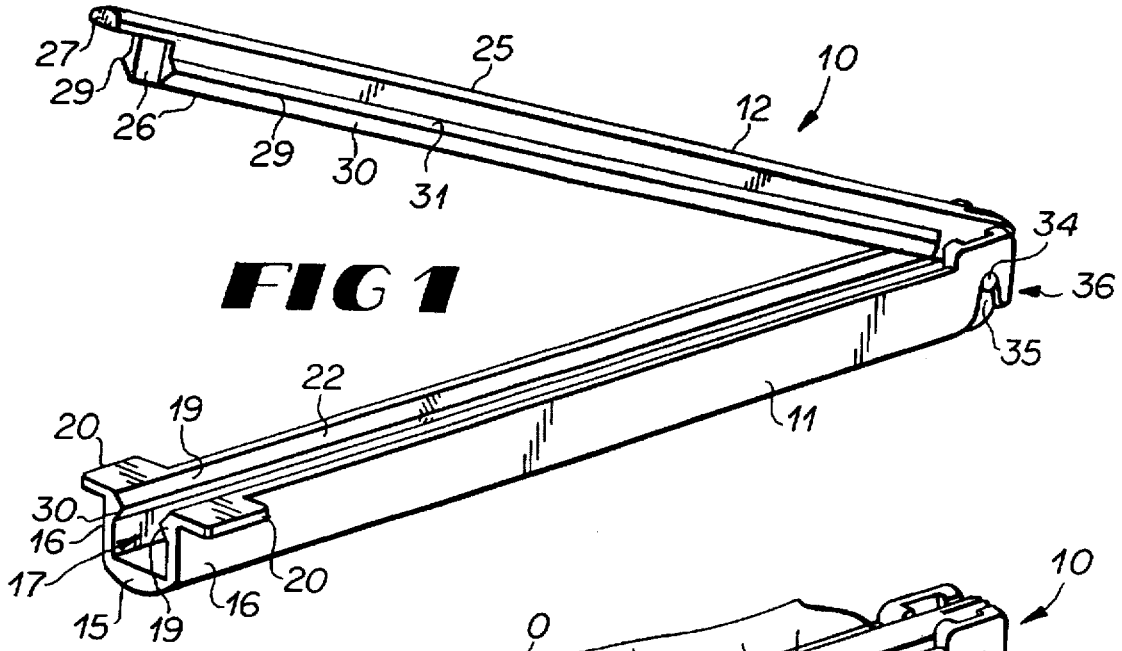
FIG 1
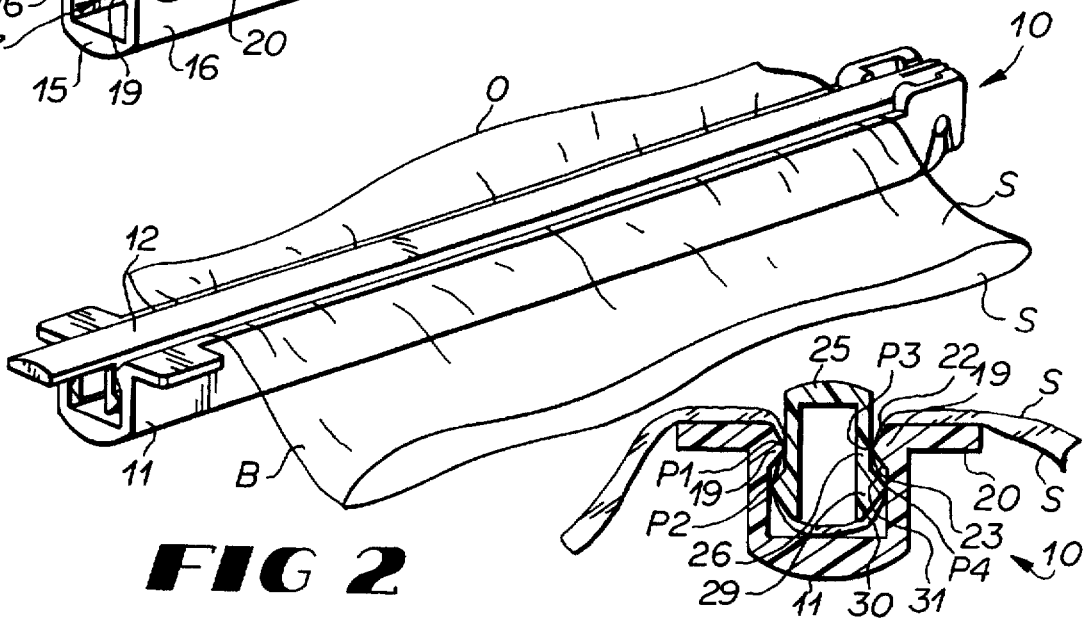
FIG 2
FIG 3
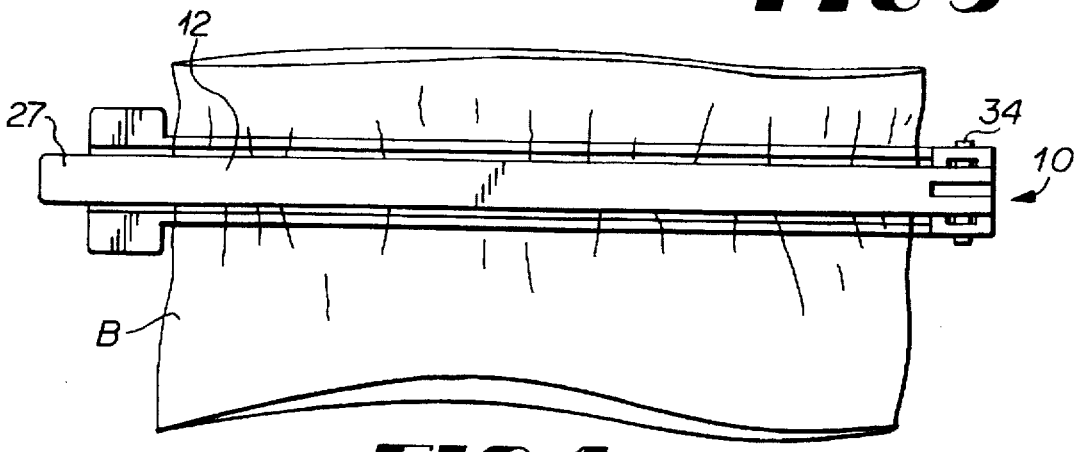
FIG 4

FLEXIBLE BAG SEALING DEVICE

TECHNICAL FIELD

This invention relates to devices used to reseal open, flexible bags and the like.

BACKGROUND OF THE INVENTION

Perishable items, such as food, are often packaged for stored and transported in plastic bags. Once these bags are opened they are often closed with a closure to restrict air from degrading their contents. Thus, it is most desirable for such closures to maintain an airtight seal. Furthermore, the closure should be capable of being reused to reestablish the airtight sealing of the bag.

In the past bag sealing closures have been designed to maintain an airtight seal in an open bag closed therein. One type of closure has two elongated, rigid arms which are spring biased toward each other. The spring biasing of the arms forces the sides of the bag therebetween together in order to seal the bag. However, should the sides of the bag be folded or crimped an air passage typically forms which allows air to enter the bag. Also, the spring is typically positioned in the middle of the arms. Hence, any fold in the bag will restrict or even prevent the arms from being brought fully together outward of the fold. Hence, it should be understood that these types of closures may not provide a constant pressure along their entire length. These types of closures have also been modified to includes ribs in an attempt to concentrate the biasing force of the spring along one edge. These closures however still suffer from the problems previously mention, albeit to a lesser degree.

Closures has also been designed having a blade pivotably mounted to a sheath by a hinge and a latch opposite the hinge for maintaining the blade in a locked position, as disclosed in U.S. Pat. Nos. 4,296,529, 4,887,335 and 5,050,272. In use, the side of the bag are captured between the closed blade and the sheath so as to seal the bag. Here too however, a fold in the sides of the bag may cause a separation of the blade and sheath to either side of the fold. This separation may allow air to escape through the unclasped portion of the bags. Hence, it is seen that these types of closures also do not maintain a constant pressure along their entire length.

Thus, there exists a need for an improved closure for flexible containers such that the container is sealed along the entire length of the closure. Accordingly, it is to the provision of such that the present invention is primarily directed.

SUMMARY OF THE INVENTION

In a preferred form of the invention, a bag sealing device is movably configurable in an open configuration and in a closed configuration pinch sealing a bag. The bag sealing device comprises a receiving arm having an elongated groove partially defined by two oppositely disposed, inwardly facing, elongated seating shoulders and a locking arm having an elongated tongue with two oppositely disposed, outwardly facing, elongated seating shoulders configured to interlock with the receiving arm seating shoulders with the device in a closed configuration with a pinched portion of the bag positioned between the receiving arm and the locking arm. The device also has hinge means for hingedly coupling the receiving arm with the locking arm. With this construction and with the receiving arm and the locking arm oriented in an open configuration a flexible bag may be placed therebetween and with the receiving arm and locking arm brought together into a closed configuration with opposite sides of the bag within the receiving arm groove the bag is captured and sealed by the interlocking engagement of the seating shoulders of receiving arm and the seating shoulders of the locking arm.

BRIEF DESCRIPTION OF THE DRAWINGS

FIG. 1 is a perspective view of the bag sealing device embodying principles of the invention in a preferred form.

FIG. 2 is a perspective view of the bag sealing device shown in FIG. 1, shown in a closed configuration sealing a bag.

FIG. 3 is a cross-section view of the bag sealing device shown in FIG. 1, shown in a closed configuration sealing a bag.

FIG. 4 is a top view of the bag sealing device shown in FIG. 3, shown in a closed configuration sealing a bag.

DETAILED DESCRIPTION OF THE INVENTION

Referring next to the drawings, there is shown a bag sealing device 10 having an elongated, U-shaped receiving arm or channel member 11 and an elongated, inverted U-shaped locking arm or channel member 12. The receiving arm 11 has a bottom wall 15 and two generally parallel side walls 16 extending from the bottom wall 15 defining a groove 17 therebetween. Each side wall 16 has an inwardly facing seating shoulder 19 and an outwardly facing gripping flange 20. Seating shoulders 19 have an insertion camming surface 22 and an extraction camming surface 23 which converge toward each other as they extend inwardly. The locking arm 12 has a top wall 25, two generally parallel side walls 26 extending from the top wall so as to form a tongue sized and shaped to be received within groove 17, and a gripping flange 27 extending outwardly from the top wall 25. Each side wall 26 has an outwardly facing seating shoulder 29. Seating shoulders 29 have an insertion camming surface 30 and an extraction camming surface 31 which converge toward each other as they extend outwardly. The locking arm 12 also has a hinge pin 34 configured to be received within a mounting hole 35 extending through the receiving arm 11 so as to from a hinge 36 hingedly coupling the locking arm with the receiving arm. Preferably, the receiving and locking arms are made of a composition consisting of approximately 93% polypropylene and 7% rubber.

In use, a flexible bag B, such as a plastic bag, is positioned between the separated receiving arm 11 and locking arm 12 such that the bag opening 0 is to one side of the sealing device and the contents within the bag are to the other side of the sealing device. The device is then closed by positioning the locking arm side walls 26 within the receiving arm groove 17 with the bag side walls S positioned therebetween and the locking arm seating shoulders 29 interlocked with the seating shoulders 19 of the receiving arm, as best shown in FIG. 3.

The resiliency of the device, through its material composition, allows the side walls 16 of the receiving arm 11 to flex outwardly and the side walls 26 of the locking arm 12 to flex inwardly as the seating shoulders 19, 29 pass each other, and to snap back once the seating shoulders have pasted each other. The configuration of the seating shoulders insertion camming surface 22, 30 of the receiving and locking arms aids in guiding the locking arm into the receiving arm and directing the flex of side walls 16, 26. The receiving arm side walls 16 are flexed outwardly while the locking arm side walls 26 are flexed inwardly. It should be understood that the closing of the device is best accomplished by forcing the portion of the locking arm side walls 26 into the receiving arm groove 17 adjacent the hinge 36 and then progressively inserting more and more of the locking arm side walls into the groove in a direction towards flange 27.

With the device fully closed the plastic bag B is clasped in an airtight manner. As best shown in FIG. 4, the device pinches the side walls S of the bag along four separate pinching positions P1, P2, P3, P4 to ensure an airtight seal. This is accomplished by pinching the bag between each of the receiving arm seating shoulders 19 and the locking arm side walls 26, at positions P4, and between each of the locking arm seating shoulders 29 and the receiving arm side walls 16 at positions P2, P3. Hence, should a fold be formed in a bag the fold would have to pass all four pinching positions to present an open air passageway. However, even should the fold extend through the four pinching positions P1, P2, P3, P4 the resiliency of the device limits the creation of air passageways, a problem previously explained in reference to the prior art. For should a fold appear between a seating shoulder and its adjacent side wall that portion of the seating shoulder contacting the bag fold is biased away from the adjacent side wall without substantially biasing or otherwise effecting the adjacent portions of the seating shoulder. Additionally, the biasing of the seating shoulder and the side wall from which it extends causes an increase in the pressure exerted upon the fold by the seating shoulder, i.e. the flexing of the side walls increases the pressure of the seating shoulders upon the fold in the bag.

Furthermore, should the bag be forced in such a manner so as to force it from the sealing device the locking arm seating shoulder 29 would be moved to a position against the receiving arm seating shoulder 19. Thus, the bag side walls S would also become pinched between the interlocking seating shoulders 19 and 29. Hence, to a degree, the forcing of the bag from the sealing device actually increases the sealing characteristics of the device.

To release the bag one merely forces the locking arm side walls 26 from the receiving arm groove 17 by pulling upon the locking arm gripping flange 27 while simultaneously pushing upon the receiving arm gripping flanges 20. Here, the locking arm side walls are first extracted from the receiving arm 11 adjacent the gripping flanges and then progressively extracted thereafter in a direction towards the hinge 36. The extraction of the locking arm side walls is aided by the configuration of the extraction camming surface 23, 31 of the seating shoulders 19, 29 respectively, which again directs the outward flexing of receiving arm side walls 26 and the inward flexing of the locking arm side walls 16.

The material composition of the device allows it to be stored within a conventional freezer and opened immediately upon its removal therefrom without cracking or otherwise damaging the frozen device. It has been found that devices configured in the previously described manner do not work as well if they are made of nylon or of polypropylene with a rubber content less than 3%, as these devices do not flex well thus making the insertion and extraction of their locking arm extremely difficult. This is especially true when the device has been immediately removed from a freezer. Also, it has been found that devices made of polyethylene or of polypropylene combined with a rubber content of greater than 15% have proved to be too flimsy, such that a snug or adequate locking of the arms does not occur.

Thus, an improved sealing device for flexible bags is now provided which seals the bag in an airtight manner even with folds formed in the bag. While this invention has been described in detail with particular reference to a preferred embodiment thereof, it should be understood that many modifications, additions and deletions may be made thereto without departure from the spirit and scope of the invention as set forth in the following claims.

We claim:

1. A bag sealing device movably configurable in an open configuration and in a closed configuration pinch sealing a bag comprising:

a receiving arm having an elongated groove partially defined by two oppositely disposed, inwardly facing, elongated seating shoulders, a locking arm having an elongated tongue with two oppositely disposed, outwardly facing, elongated seating shoulders configured to interlock with said receiving arm seating shoulders with said device in a closed configuration with a pinched portion of the bag positioned between said receiving arm and said locking arm, and hinge means for hingedly coupling said receiving arm with said locking arm, whereby with the receiving arm and the locking arm oriented in an open configuration a flexible bag may be placed therebetween and with the receiving arm and locking arm brought together into a closed configuration with opposite sides of the bag within the receiving arm groove the bag is captured and sealed by the interlocking engagement of the seating shoulders of receiving arm and the seating shoulders of the locking arm.

2. The bag sealing device of claim 1 wherein said locking arm tongue is comprised of two resilient, elongated members each having one said tongue seating shoulder.

3. The bag sealing device of claim 2 wherein said receiving arm is resilient.

4. The bag sealing device of claim 1 wherein said receiving arm seating shoulders have converging side walls as said shoulders extend inwardly.

5. The bag sealing device of claim 4 wherein said locking arm seating shoulders have converging side walls as said shoulders extend outwardly.

6. The bag sealing device of claim 1 wherein said receiving arm and said locking arm each have at least one outwardly extending grasping flange opposite said hinge means.

7. The bag sealing device of claim 1 wherein said receiving arm and said locking arm are comprised of a composite containing polypropylene and rubber.

8. The bag sealing device of claim 7 wherein said rubber comprises between 3% and 15% of said composite by volume.

9. A bag sealing device comprising:

a receiving channel member having two generally parallel side walls each having an inwardly facing, elongated seating shoulders, a locking channel member having two generally parallel side walls each having an outwardly facing, elongated seating shoulder, said locking channel member being sized and shaped to be at least partially received within said receiving channel member with said seating shoulders of said locking channel member interlocking with said seating solders of said receiving channel and a portion of a bag to be sealed positioned between said receiving channel member and said locking channel member, and hinge means for hindedly coupling said receiving channel member with said locking channel member, whereby with the receiving channel member and the locking channel member separated a flexible bag may be placed therebetween, and with the receiving channel member brought into the locking channel member the bag is captured and sealed therebetween, and whereby the receiving channel member is maintained within the locking channel member by the interlocking engagement of the seating shoulders of the receiving channel members with the seating shoulders of the locking channel member.

10. The bag sealing device of claim 9 wherein said receiving channel member and said locking channel member each have at least one outwardly extending grasping flange opposite said hinge means.

* * * * *